US008737906B2

(12) United States Patent
de Jong et al.

(10) Patent No.: US 8,737,906 B2
(45) Date of Patent: May 27, 2014

(54) SUBSTRATE MEDIA HEIGHT MEASUREMENT SYSTEM AND METHOD

(71) Applicants: Joannes N. M. de Jong, Hopewell Junction, NY (US); Thomas Wyble, Williamson, NY (US)

(72) Inventors: Joannes N. M. de Jong, Hopewell Junction, NY (US); Thomas Wyble, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 55 days.

(21) Appl. No.: 13/630,871

(22) Filed: Sep. 28, 2012

(65) Prior Publication Data

US 2014/0092159 A1 Apr. 3, 2014

(51) Int. Cl.

| | |
|---|---|
| ***G03G 15/00*** | (2006.01) |
| ***B41J 2/01*** | (2006.01) |
| ***B41J 29/38*** | (2006.01) |

(52) U.S. Cl.
USPC ..... 399/406; 347/101; 347/104; 347/16

(58) Field of Classification Search
USPC ..... 347/16, 101, 104; 399/406
See application file for complete search history.

(56) References Cited

U.S. PATENT DOCUMENTS

| | | | | |
|---|---|---|---|---|
| 5,934,140 | A * | 8/1999 | Jackson et al. | 73/159 |
| 6,668,155 | B1 | 12/2003 | Hubble, III et al. | |
| 7,545,519 | B2 | 6/2009 | Ossman et al. | |
| 7,548,316 | B2 | 6/2009 | Castillo et al. | |
| 2009/0154976 | A1 * | 6/2009 | Castillo et al. | 399/406 |
| 2011/0196650 | A1 * | 8/2011 | Yang et al. | 702/166 |

* cited by examiner

*Primary Examiner* — Sarah Al Hashimi

(57) ABSTRACT

A system and method for determining substrate media height including a media transport having a transport surface for carrying thereon substrate media along a media path in a process direction past a print zone. A media height detector is disposed upstream of the print zone. The height detector includes an elongate member disposed above the transport surface and extending across the transport surface in a cross-process direction. The elongate member is slanted with respect to the transport surface with a distance between the elongate member and the transport surface decreasing as the detector extends in the process direction. The height detector includes a deflection sensor operably connected to the elongate member. The deflection sensor senses deflection of the elongate member.

16 Claims, 6 Drawing Sheets

SUBSTRATE MEDIA HEIGHT MEASUREMENT SYSTEM AND METHOD

TECHNICAL FIELD

This disclosure relates to a system and methods for measuring the curl of substrate media, particularly for measuring the height of substrate media using a slanted elongate member.

BACKGROUND

Substrate media such as paper is prone to having the leading and or trailing edges curl up such that the sheet does not lie flat across its entire surface. Media curl is frequently considered one of the root causes of media jams in media handling and registration. Media curl can be induced by several factors such as, for example, relative humidity, media weight, media size, sides imaged or the amount of data contained with a particular digital image.

An important dimension associated with an inkjet printing process, including solid ink jet (SIJ) printing process, is the small print gap between the ink jet heads and the receiving media or drum in the case of drum printing systems. This print gap is on the order of 0.5 mm, and must be tightly controlled to maintain accurate drop placement which in turn results in acceptable image quality. In a web-based media handling system, one can maintain this print gap relatively easily with the proper geometry and web tension. However, for cut-sheet SIJ systems, the sheet edges pose a more difficult problem to solve, as the edges can be lifted up from a media transport due to curl thereby increasing the height of the media. Up-curl designates a direction of the curl towards the print head and down-curl away from the print head. The up and down directions are thus not with respect to gravity, but rather with respect to the print head. Also note that no assumption is made relative to the angle of the mounting of the print head If these curled edges result in a media height greater than the print gap, the media will come into contact with the print heads during operation, and damage to the jets could occur. As the print heads are expensive, this scenario negatively impacts run costs.

Therefore, it is desirable not to have any or a very minimal amount of up-curl (curl toward the print head). For this purpose a sheet curler is typically used upstream of the print head area. Media curlers are used to remove or impose a certain amount of curl. Media is transported onto the hold-down transport using a traditional nip based registration transport with nip releases. For satisfactory operation, the amount of media curl to be removed is input to the curler control which adapts curler setting based on input curl and desired output curl. Upstream of the registration transport a sheet curler imparts a known amount of curl to the sheet to make sure no or minimal up-curl is present after the sheet is acquired by a hold-down transport. In order to achieve this, a measurement of the maximum sheet height is desirable. Then, the curl controller can modify curler settings to obtain no or minimal up-curl. Common input curl measurements report the amount of curl in only one or two locations across the leading edge ("LE") or trailing edge ("TE") of a sheet. However, these one or two measurements typically do not represent the maximum curl of the sheet and hence do not give an accurate amount of curl to be removed be the curler.

Accordingly, it would be desirable to provide a device and method for accurately and efficiently measuring media curl.

SUMMARY

According to aspects described herein, there is disclosed a system for determining substrate media height including a media transport having a transport surface for carrying thereon substrate media along a media path in a process direction past a print zone. A media height detector is disposed upstream of the print zone. The height detector includes an elongate member disposed above the transport surface and extending across the transport surface in a cross-process direction. The elongate member is slanted with respect to the transport surface with a distance between the elongate member and the transport surface decreasing as the detector extends in the process direction. The height detector includes a deflection sensor operably connected to the elongate member. The deflection sensor senses deflection of the elongate member.

According to further aspects described herein, there is disclosed a system for correcting media curl in a printing apparatus including a media transport having a transport surface for carrying thereon substrate media in a process direction past a print zone. A media height detector includes an elongate member disposed above the transport surface and extends across the transport surface in a cross-process direction. The elongate member is slanted with respect to the transport surface with a distance between the elongate member and the transport surface decreases as the elongate member extends in the process direction. The detector includes a deflection sensor operably connected to the elongate member. The deflection sensor senses deflection of the elongate member. A media curler is disposed in a path of the media. The curler is in operative communication with the detector, and the curler curls the substrate media responsive the sensed media height.

According to still further aspects described herein, there is disclosed a method for determining curl height in a substrate media including:

providing a slanted elongate member extending in a cross-process direction across a media path;

providing a reference sensor for determining sheet arrival time at a reference location;

determining a travel time for a sheet to travel from the reference location to engaging the elongate member; and determining with a processing device the height of the sheet responsive to the travel time.

DETAILED DESCRIPTION

Figure 1:
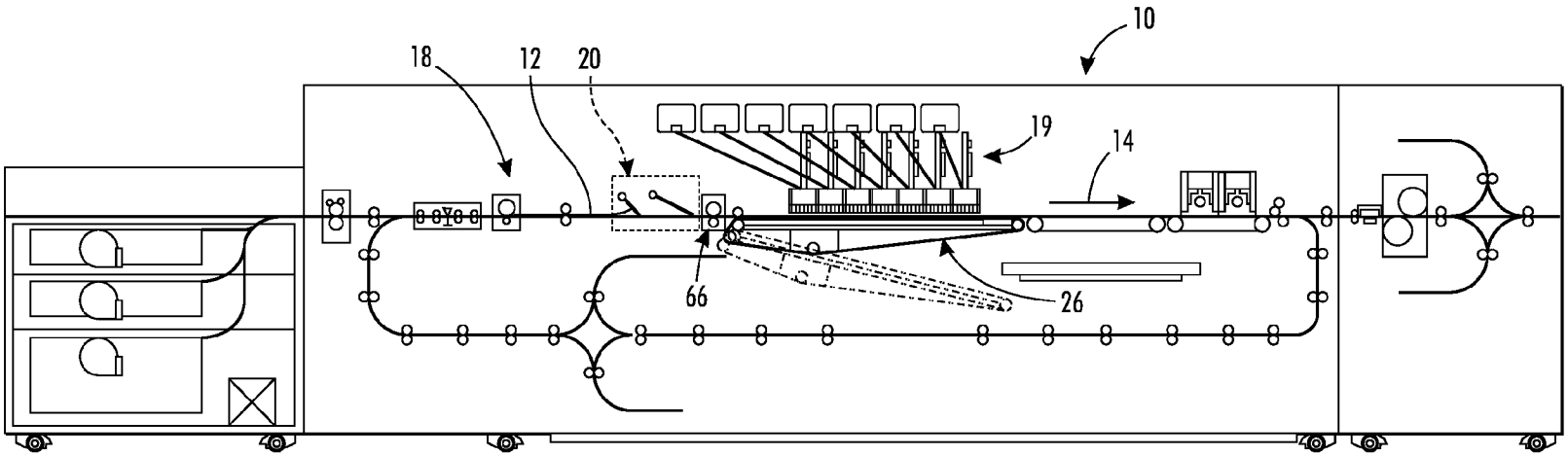
FIG. 1 is a schematic representation of a printing assembly including a media height detector.

Describing now in further detail these exemplary embodiments with reference to the Figures, as described above, a system for measuring the height of substrate media is typically used in a select location or locations of the paper path or paths of various conventional media handling assemblies. Thus, only a portion of an exemplary media handling assembly path is illustrated herein.

As used herein, a "printer," "printing assembly" or "printing system" refers to one or more devices used to generate "printouts" or a print outputting function, which refers to the reproduction of information on "substrate media" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate record and reproduce information, or other suitable processes for generating printouts, such as an ink jet process, a liquid ink process, a solid ink jet (SIJ) process, and the like. Also, such a printing system can print and/or handle either monochrome or color image data.

As used herein, "substrate media" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in the process direction. The "trailing edge" of a substrate media refers to an edge of the sheet that is furthest upstream in the process direction. The "lateral edge" or "lateral edges" of the substrate media refers to one or more of the opposed side edges of the sheet, extending substantially in the process direction.

As used herein, a "media transport" refers to one or more devices used for handling and/or transporting substrate media, including feeding, printing, finishing, registration and transport systems.

As used herein, a "transport surface" refers to a surface on which a substrate media is supported as it travels along the media path.

As used herein, "sensor" refers to a device that responds to a physical stimulus and transmits a resulting impulse for the measurement and/or operation of controls. Such sensors include those that use pressure, light, motion, heat, sound and magnetism. Also, each of such sensors as refers to herein can include one or more point sensors and/or array sensors for detecting and/or measuring characteristics of a substrate media, such as speed, orientation, process or cross-process position and even the size of the substrate media. Thus, reference herein to a "sensor" can include more than one sensor.

As used herein, the terms "process" and "process direction" refer to a process of moving, transporting and/or handling a substrate media. The process direction is a flow path (also described as a media path) the substrate media moves in during the process. A "cross-process direction" is perpendicular to the process direction and generally extends parallel to the sheet or web of the substrate media.

As used herein, the term "sheet height" refers to the dimension as measured from a reference plane, such as a transport surface, to the vertical extent of the substrate media. When the edges of the substrate media are curled upwardly, up-curl, or downwardly, down-curl, this tends to increase the sheet height since the media no longer lies flat on a surface.

As used herein, the term "media height detector" refers to a device and or devices that determine the maximum distance that a piece of substrate media extends above a media support surface. The curl of a sheet of media will affect the media height.

As used herein, a "processing device" refers to a controller (s) or processor(s) that executes instructions implement a process, procedure, computation, and the like. A processing device may include memory and other hardware/software to carry out desired functions.

As used herein, the term "print zone" refers to a zone along a path a substrate is moving, where a coating or marking material of any kind (ink, toner, lamination, overcoat etc.) is placed in on the substrate, using any technology.

Figure 2:
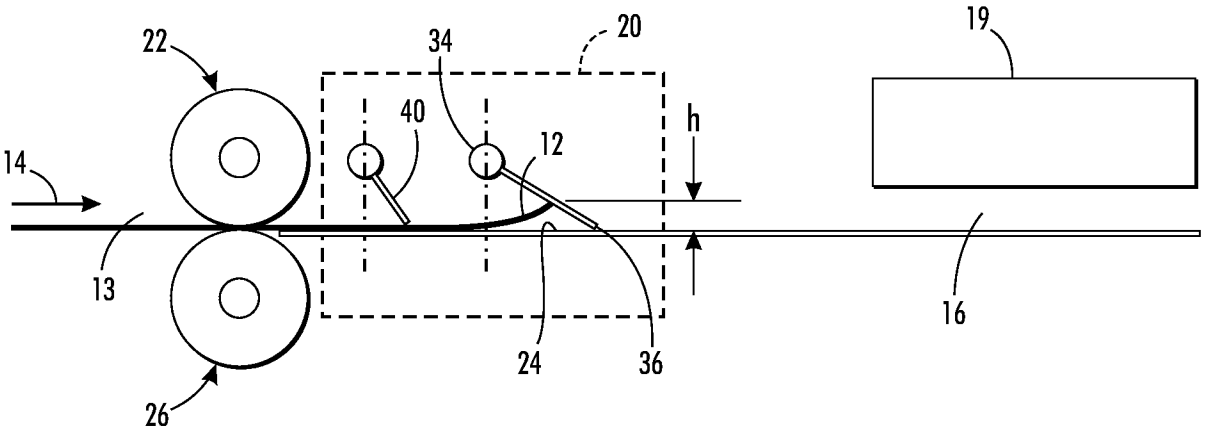
FIG. 2 is a schematic representation of a height detector in accordance with the present disclosure.

With reference to FIGS. 1 and 2, the present disclosure provides a system and method for improved measurement of substrate media height and in particular measurement of sheet curl. In a printing system 10, a curled substrate media 12 is propelled along a process path 13 in a process direction (arrow 14) toward a print zone 16 by a media transport 18. The print zone 16 may include one or printing devices 19 such as print heads. A media height detector 20 is disposed in the process path. The height of the media, h, is determined responsive to time it takes for the media to hit the height detector.

Figure 3:
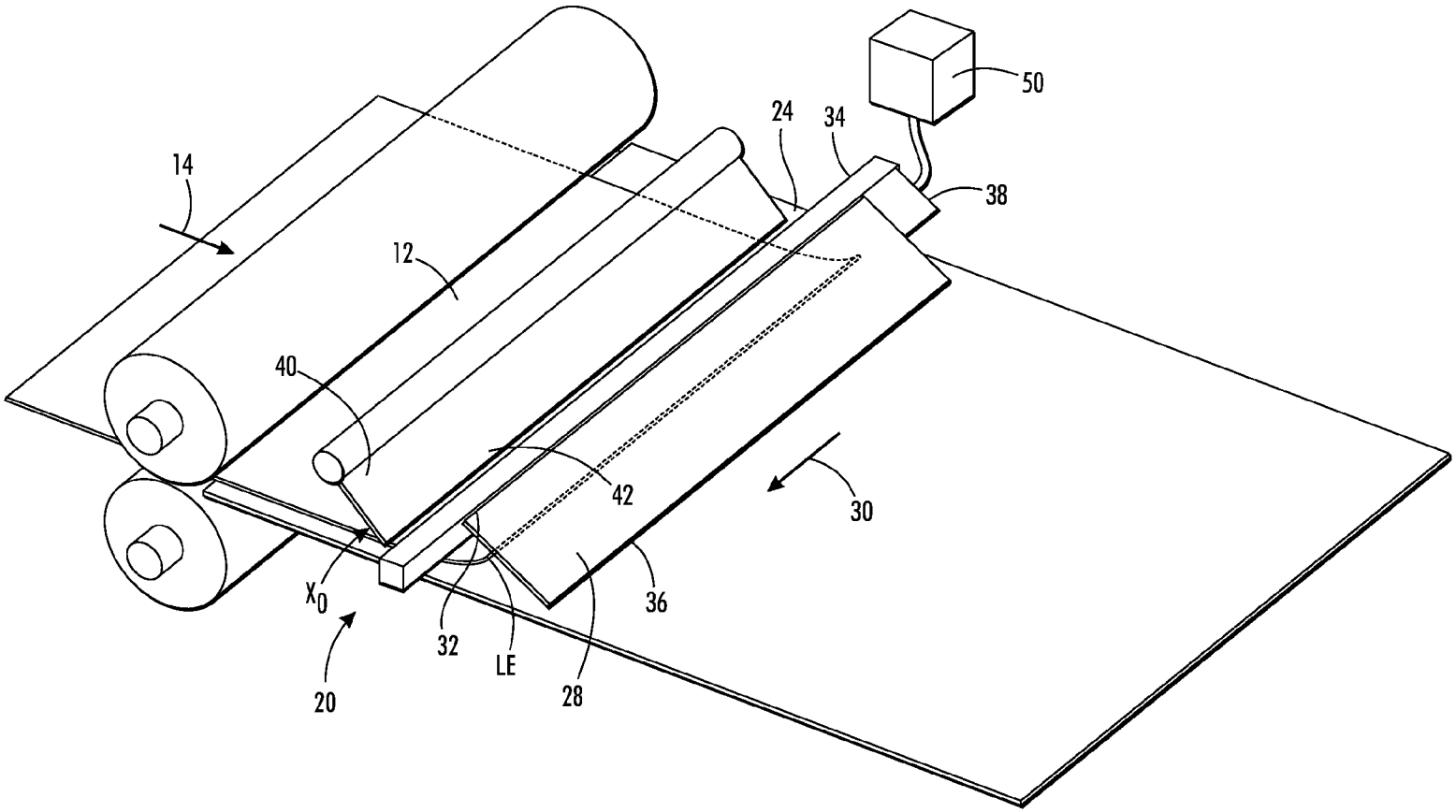
FIG. 3 is a perspective view of the media height detector of FIG. 2.

With reference to FIGS. 2 and 3, the printing system 10 includes a media transport 22 having a transport surface 24 for carrying thereon the substrate media 12 in the process direction 14. The media, shown in the form of a sheet, is transported past the print zone 16 upon which an image is formed on the substrate media. The media transport 22 may include a drive nip 24 including a pair of rollers 26 which engage the media and drive it along the process direction. The media transport 22 may also be in the form of a belt-driven transport and/or a sled device of a type known in the art. The media may be held down onto the transport surface by vacuum, and/or electrostatic hold-down, and/or mechanical devices.

The media height detector 20 is disposed in the media path upstream of the print zone 16. The height detector 20 may include an elongate member 28 disposed above the transport surface and extending across the transport surface in a cross process direction (arrow 30). The elongate member 28 may be in the form of a relatively thin straight edge which is deflectable upon engagement with the media 12. The elongate member may have lightening holes, have a comb shape, use stiffening ribs, or other methods to reduce the weight. The elongate may have a back edge 32 secured to a support member 34 thereby supporting the elongate member above the transport surface. The elongate member may include a front edge 36 disposed adjacent to the transport surface.

The elongate member 28 is slanted at a predetermined angle with respect to the transport surface with a distance between the elongate member 28 and the transport surface 24 decreasing as the elongate member 28 extends in the process direction 14. The elongate member 28 may be formed of a metallic material and having a generally straight planar surface extending along a length of the member.

The height detector 20 may further include a deflection sensor 38 operably connected to the elongate member. The deflection sensor detects movement, deflection or any type of movement of the elongate member. Such movement may be created when the leading edge of a sheet of media (LE) engages the elongate member. The sensor operably connected to the elongate member may be in the form of a strain gauge, displacement sensor or other sensor as known in the art adapted to detect deflection of the elongate member 28. The use of a slanted member allows the height detector to measure maximum curl along the entire lead/trail edge.

The height detector 20 may further include a reference sensor 40 disposed upstream of the elongate member 28. The reference sensor 40 senses the presence of the substrate media as it passes thereby. The reference sensor 40 provides an indication that the leading edge of the sheet has passed a reference location $x_o$. The reference sensor may be in the form of a leading edge sensor, a nip thump or a straight edge extending along the media path. In one embodiment, the reference sensor may be formed similarly to the elongate member having an elongate straight edge 42 supported at an angle to the transport surface 24 having a front edge 44 disposed adjacent the transport surface. The reference sensor is engagable by a sheet of media and generates a signal upon such engagement.

The media height detector 20 may further include a processing device 50 configured to determine the media height h based on an angle of the elongate member relative to the transport surface and a time difference between the sheet passing the reference location and engaging the elongate member.

The height is determined based on the time it takes the sheet edge to travel a known distance and engage the slanted elongate member 28. Depending upon the height of the media 12 above the transport surface 24, the distance upstream of the front edge of the elongate member where the leading edge of the sheet engages the elongate member will vary. For example, the sheets of media having greater height will engage the elongate member 28 further upstream than sheets having a lower height. Accordingly, the time it takes a sheet moving at a constant velocity to pass the reference location and engage the elongate member 28 will be a function of the media height and, in particular, the amount of curl.

Figure 4:
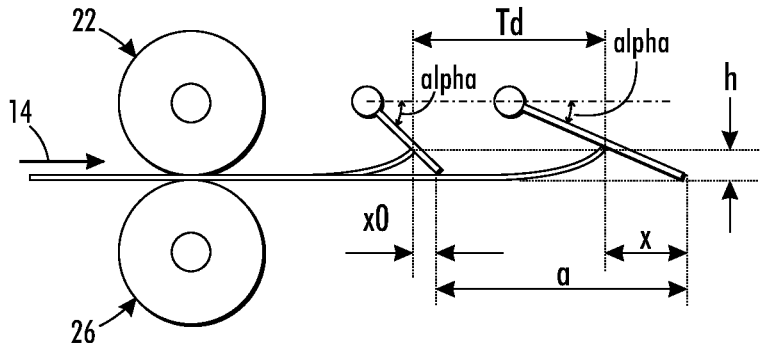
FIG. 4 is a schematic representation of a height detector of FIG. 2 showing dimensional variable and constants.
Figure 5:
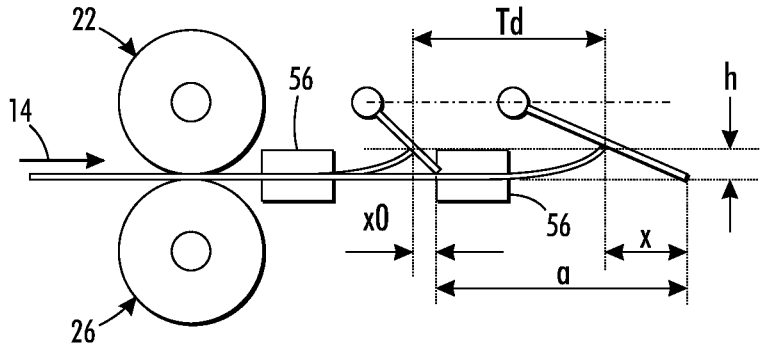
FIG. 5 is a schematic representation of a height detector of FIG. 2 shown with constraining baffles.

With reference to FIG. 4, there is a linear relationship between the height of the front edge of the member and the time for the media to travel from a reference location to engagement with the elongate member. A shown in FIG. 4, the reference sensor is used to determine when the leading edge of the media has past the reference location. The time it takes for the leading edge to engage the elongate member is determined from that value. The height of the media can be determined using the mathematical equations below with V being the media velocity (a known constant), $alpha_o$ and alpha being the angle formed between the media path and the reference straight edge and between the media path the elongate member respectively, and "a" being the distance between the front edges of the reference straight edge and elongate member:

$V*Td=a+(x_o-x)$ $h=x*\tan(alpha)$ $x=h/\tan(alpha)$ $h=xo*\tan(alpha_o)$ $xo=h/\tan(alpha_o)$ $(V*Td-a)=h(1/*\tan(alpha_o)=1/\tan(alpha))$ $h=(V*Td-a)*\tan(alpha_o)*\tan(alpha)/(\tan(alpha)-\tan(alpha_o))$ As shown in FIG. 5, constraining baffles 56 may be used to help guide the media through the height detector and help avoid jams.

Figure 6:
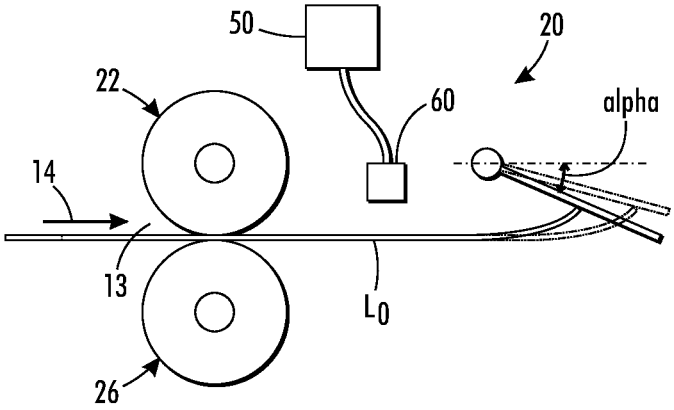
FIG. 6 is a schematic representation of an alternative embodiment of a height sensor of the present disclosure, showing a piece of substrate media before and after engaging an elongate member of the height detector.
Figure 7:
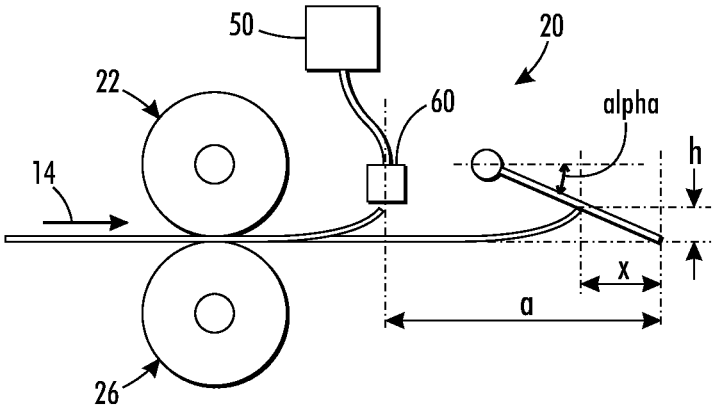
FIG. 7 is a schematic representation of a height detector of FIG. 6 showing dimensional variable and constants.

In an alternative embodiment shown in FIGS. 6 and 7, the reference location $L_0$ may be determined by a sensor 60 located at the reference location. When the leading edge of the media passes the sensor, a timer in the processing device 50 may begin keeping the time until the leading edge of the media engages and deflects the elongate member 28. With the time for the sheet know to pass the reference location until it engages the elongate member known, the media height can be calculated. The velocity of the sheet, V, is a known constant. The angle, alpha, of the slanted edge with respect to the media path is also known. The distance between the front edges of the elongate member and the reference sensor, a, is also known.

The following equations may be used to determine the height of the media:

$$x=a-V*Tc$$

$$h=x*\tan(alpha)$$

$$h=(a-V*Tc)*\tan(alpha)$$

Figure 8:
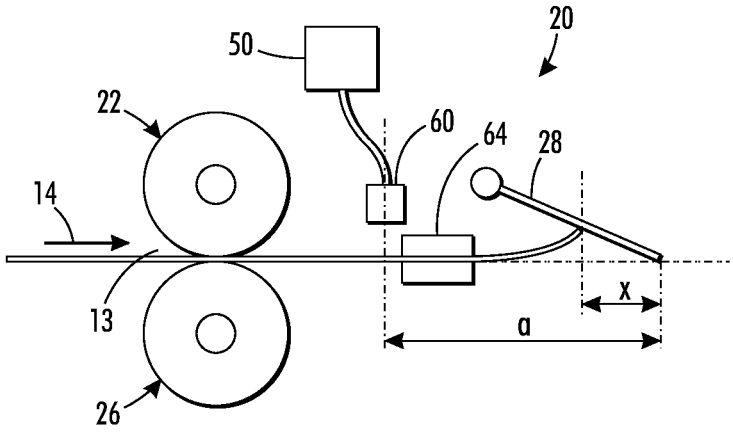
FIG. 8 is a schematic representation of a height detector of FIG. 6 shown with constraining baffles.

As shown in FIG. 8, a constraining baffle 64 may be used to guide the media and help prevent jams.

Once the height of the sheet is known, this height can be related to the sheet curl of the leading edge. In order to reduce or remove such leading edge curl, a curler 66 (FIG. 1) may be used. The curler 66 may be disposed down stream of the height detector. The height detector 20 may be in operative communication with the curler 66 such that the detected height is transmitted to the curler. Once the height of the sheet of media substrate 12 is determined, curl parameters based on this height may be fed into the curler so that an opposite curl may be placed on the media edge to reduce or remove the curl. As noted above, it is desirable that the sheet sit as flat as possible on the transport surface as it passes through the print zone 16. If the sheet exceeds a certain height, it may engage the print heads of the print zone damaging the print heads and/or reducing the quality of the printed image. In an alternative embodiment, the curler may be located upstream of the height detector in which case the curl of the current sheet is measured and the sheet can be discarded so as to not interfere with the print head. The parameters of the curler can then be adjusted for the next sheet under the assumption that the curls of sheets in a stack are similar.

The height detector 20 measures maximum curl along the entire lead/trail edge. Trail edge curl can also be measured using this height detector. In this case, the time instant when the slanted elongate member decreases in height is detected and recorded. If desired, limited down curl can be also measured with this device. Alternatively, an additional device can be used that is mounted upside down.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A system for determining substrate media height comprising:

a media transport having a transport surface for carrying thereon substrate media along a media path in a process direction past a print zone;

a media height detector disposed upstream of the print zone, the height detector including an elongate member disposed above the transport surface and extending across the transport surface in a cross-process direction, the elongate member being slanted with respect to the transport surface with a distance between the elongate member and the transport surface decreasing as the detector extends in the process direction; and the height detector including a deflection sensor operably connected to the elongate member, the deflection sensor sensing deflection of the elongate member; a reference sensor disposed upstream of the elongate member, the reference sensor sensing the presence of the substrate media;

a processing device for determining media height responsive to the time difference between the media activating the reference sensor to when the media engages the elongate member.

2. The system as defined in claim 1, the reference sensor includes a leading edge sensor.

3. The system as defined in claim 1, the wherein leading edge sensor includes a straight edge extending along the media path.

4. The system as defined in claim 1, wherein the straight edge is slanted with respect to the transport surface.

5. The system as defined in claim 1, wherein the processing device determines the media height based on an angle of the elongate member relative to the transport surface, and a distance of between the reference location and the elongate member.

6. The system as defined in claim 1, wherein a constraining baffle is disposed upstream of the media height detector.

7. The system as defined in claim 1, wherein the media transport includes a drive nip for moving the substrate media in the process direction.

8. The system as defined in claim 1, wherein the elongate member is supported at a first edge and extends from the first edge toward the transport surface to a second edge, wherein the second edge is disposed downstream of the first edge.

9. A system for correcting media curl in a printing apparatus comprising:

a media transport having a transport surface for carrying thereon substrate media in a process direction past a print zone;

a media height detector including an elongate member disposed above the transport surface and extending across the transport surface in a cross-process direction, the elongate member being slanted with respect to the transport surface with a distance between the elongate member and the transport surface decreasing as the elongate member extends in the process direction;

the detector including a deflection sensor operably connected to the elongate member, the deflection sensor sensing deflection of the elongate member; and a media curler disposed in a path of the media, the curler being in operative communication with the height detector, and the curler curling the substrate media responsive the sensed media height; a reference sensor disposed upstream of the elongate member, the reference sensor sensing the presence of the substrate media;

a processing device for determining media height responsive to the time difference between the media activating the reference sensor to when the media engages the elongate member.

10. The system as defined in claim 9, the reference sensor includes a leading edge sensor.

11. A method for determining curl height in a substrate media comprising:

providing a slanted elongate member extending in a cross-process direction across a media path;

providing a reference sensor for determining sheet arrival time at a reference location;

determining a travel time for a sheet to travel from the reference location to engaging the elongate member; and determining with a processing device the height of the sheet responsive to the travel time.

12. The method as defined in claim 11, wherein the slanted elongate member is supported above a transport surface and extends at and angle generally downwardly toward the transport surface and toward the process direction.

13. The system as defined in claim 12, wherein the elongate member is supported at a first edge and extends from the first edge toward the transport surface to a second edge, wherein the second edge is disposed downstream of the first edge.

14. The method as defined in claim 11, wherein the edge is operatively connected to a sensor for sensing the presence of a sheet leading edge.

15. The method as defined in claim 11, wherein the reference sensor includes a member extending across the media path and generating a signal when engaged by the leading edge of a sheet.

16. The method as defined in claim 11, wherein the elongate member is deflectable upon engagement by a sheet of substrate media.

* * * * *